US008991087B2

(12) United States Patent
Ruffin

(10) Patent No.: US 8,991,087 B2
(45) Date of Patent: Mar. 31, 2015

(54) FIREARM TRIGGER LOCK

(71) Applicant: Torrey S. Ruffin, Flint, MI (US)

(72) Inventor: Torrey S. Ruffin, Flint, MI (US)

( * ) Notice: Subject to any disclaimer, the term of this patent is extended or adjusted under 35 U.S.C. 154(b) by 105 days.

(21) Appl. No.: 13/887,477

(22) Filed: May 6, 2013

(65) Prior Publication Data

US 2013/0312306 A1 Nov. 28, 2013

Related U.S. Application Data

(60) Provisional application No. 61/650,644, filed on May 23, 2012.

(51) Int. Cl.

| | |
|---|---|
| ***F41A 17/00*** | (2006.01) |
| ***F41A 17/06*** | (2006.01) |
| ***F41A 17/44*** | (2006.01) |
| ***F41A 17/54*** | (2006.01) |

(52) U.S. Cl.

CPC ..... *F41A 17/066* (2013.01); *F41A 17/44* (2013.01); *F41A 17/54* (2013.01)

USPC ..... 42/70.07; 42/70.06; 42/70.11

(58) Field of Classification Search

USPC ..... 42/70.06, 70.07, 70.11

See application file for complete search history.

(56) References Cited

U.S. PATENT DOCUMENTS

| | | | | | |
|---|---|---|---|---|---|
| 1,569,553 | A * | 1/1926 | Lewis et al. | ..... | 42/70.06 |
| 1,686,482 | A * | 10/1928 | Windle | ..... | 42/70.07 |
| 2,505,227 | A * | 4/1950 | Charters | ..... | 42/70.06 |
| 2,742,726 | A * | 4/1956 | Feller | ..... | 42/70.06 |
| 3,139,694 | A * | 7/1964 | Schaefer | ..... | 42/70.06 |
| 4,499,681 | A * | 2/1985 | Bako et al. | ..... | 42/70.07 |
| 4,723,370 | A * | 2/1988 | Sheehan | ..... | 42/70.07 |
| 5,392,552 | A * | 2/1995 | McCarthy et al. | ..... | 42/70.07 |
| 5,417,000 | A * | 5/1995 | Chen | ..... | 42/70.06 |
| 5,419,068 | A * | 5/1995 | Pages et al. | ..... | 42/70.07 |
| 5,713,149 | A * | 2/1998 | Cady et al. | ..... | 42/70.06 |
| 6,253,480 | B1 * | 7/2001 | Florez | ..... | 42/70.11 |
| 6,260,300 | B1 * | 7/2001 | Klebes et al. | ..... | 42/70.11 |
| 6,408,555 | B1 * | 6/2002 | Sapia et al. | ..... | 42/70.07 |
| 6,874,265 | B1 * | 4/2005 | Pathak | ..... | 42/70.06 |
| 2002/0152661 | A1 * | 10/2002 | Strong | ..... | 42/70.07 |
| 2008/0134556 | A1 * | 6/2008 | Remelin | ..... | 42/70.07 |
| 2013/0318847 | A1 * | 12/2013 | Kelly | ..... | 42/70.06 |
| 2014/0215881 | A1 * | 8/2014 | Milde et al. | ..... | 42/70.06 |

* cited by examiner

*Primary Examiner* — Samir Abdosh

(74) *Attorney, Agent, or Firm* — Gifford, Krass, Sprinkle, Anderson & Citkowski, P.C.

(57) ABSTRACT

A trigger lock for a gun having a trigger and a trigger guard. The trigger lock has a first housing part and a second housing part and at least one of the parts includes a shackle which is insertable through the trigger guard so that the housing parts are on opposite sides of the trigger guard and so that the shackle prevents actuation of the trigger. A latch is mounted to one of the housing parts and movable between a locked and an unlocked position. In its locked position, the latch engages the shackle and secures the housing parts together. Conversely, in the unlocked position, the latch releases the shackle so that the housing parts may be separated from each other. A fingerprint scanner on one of the housing parts generates an output signal when swiped by a fingerprint. That signal is received by a processor programmed to identify one or more authorized users of the gun and, when the authorized user fingerprint swipe is identified, activates a mechanism to move the latch to the unlocked position.

8 Claims, 2 Drawing Sheets

FIREARM TRIGGER LOCK

CROSS REFERENCE TO RELATED APPLICATIONS

This application claims priority of U.S. Provisional Application 61/650,644 filed May 23, 2012, the contents of which are incorporated herein by reference.

BACKGROUND OF THE INVENTION

I. Field of the Invention

The present invention relates generally to trigger locks for firearms.

II. Description of Material Art

Many people own firearms, both rifles and handguns. Indeed, many people maintain ready access to a firearm at night to repel a possible intruder into the home. This is particularly true in high-crime areas.

A primary disadvantage of having ready access to a firearm at night for self-protection is that the firearm may be unintentionally discharged. For example, children who see the handgun and do not understand its danger may accidentally pull the trigger on the firearm and hurt themselves or others.

In order to reduce the chances of an unintentional discharge of the firearm, there are a number of previously known trigger locks which are attached to the trigger guard around the trigger. When attached to the trigger guard, these trigger locks prevent actuation of the trigger and thus prevent the accidental or unintended discharge of the firearm.

These previously known trigger locks are typically key operated and can be removed from the firearm only after insertion of the appropriate key for the trigger lock. As such, these previously known trigger locks are highly effective in preventing accidental discharge of the firearm by children or other unauthorized users of the firearm.

A primary disadvantage of these previously known key operated trigger locks, however, is that it can take a relatively long time to find the key, insert the key into the lock, and remove the trigger lock from the firearm. Consequently, in the event of an intruder into the home, there may be simply insufficient time to remove the trigger lock in order to successfully repel an intruder in the home. This is especially true since, during a high-tension situation such as the detection of a home intruder, the authorized user of the firearm may very well experience difficulty not only in locating the key for the trigger lock, but inserting the key into the lock due to his or her nervous condition.

SUMMARY OF THE PRESENT INVENTION

The present invention overcomes the above-mentioned disadvantages of trigger locks by providing a finger or thumbprint operated trigger lock for a firearm. In brief, the trigger lock of the present invention comprises a first and second housing part where at least one of the housing parts has a shackle insertable through the trigger guard and into the other housing part. Consequently, with the shackle positioned through the trigger guard and into the other housing parts, the housing parts are positioned on opposite sides of the trigger guard thus shielding the trigger from actuation. Furthermore, the shackle extending through the trigger guard itself prevents actuation or firing of the trigger by mechanically blocking the trigger from being squeezed to a firing position.

A latch is mounted to one of the housing parts and is movable between a locked position and an unlocked position. In its locked position, the latch engages the shackle and secures the housing parts together. Conversely, in its unlocked position, the latch releases the shackle so that the housing parts may be separated from each other.

A fingerprint scanner on one of the housing parts generates an output signal when swiped by a fingerprint. A processor receives the output signal from the scanner when swiped and is programmed to identify an authorized user of the gun. When the authorized user is identified, the processor generates an output signal to activate a mechanism to move the latch to its unlocked position.

The processor also preferably stores at least a plurality of sequential finger swipes to memory for subsequent download upon command of an authorized user. In addition, the processor optionally transmits a wireless signal, such as a Wi-Fi signal, each time the fingerprint scanner is swiped. The Wi-Fi system may then transmit a text message, telephone signal, email, or the like to notify the authorized user of the fingerprint swipe.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
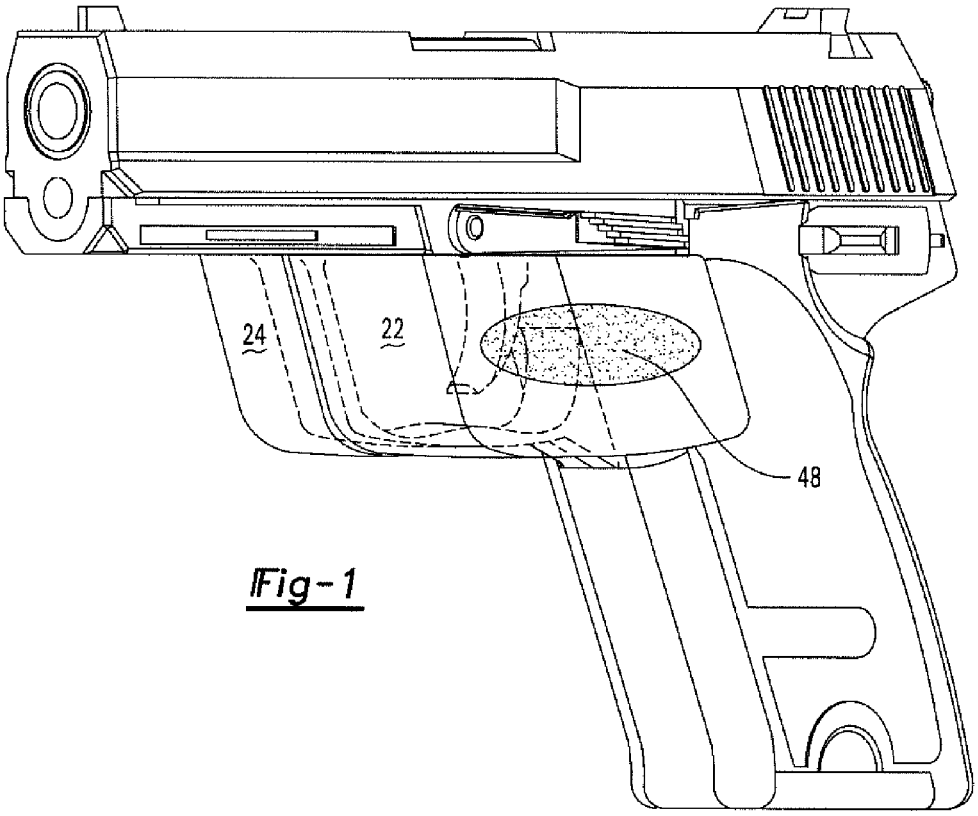
FIG. 1 is an elevational view illustrating a preferred embodiment of the invention attached to the trigger guard of a firearm.
Figure 2:
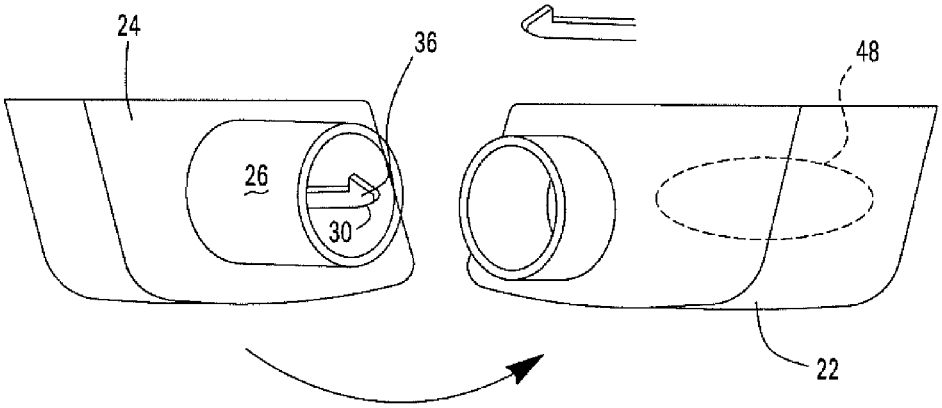
FIG. 2 is an exploded view illustrating the operation of the present invention with respect to a pistol.

With reference first to FIGS. 1 and 2, a firearm 10, such as a pistol, is shown having a trigger 12 and a trigger guard 14 around the trigger. In the conventional fashion, actuation of the trigger 12 by squeezing the trigger discharges the gun.

Figure 3:
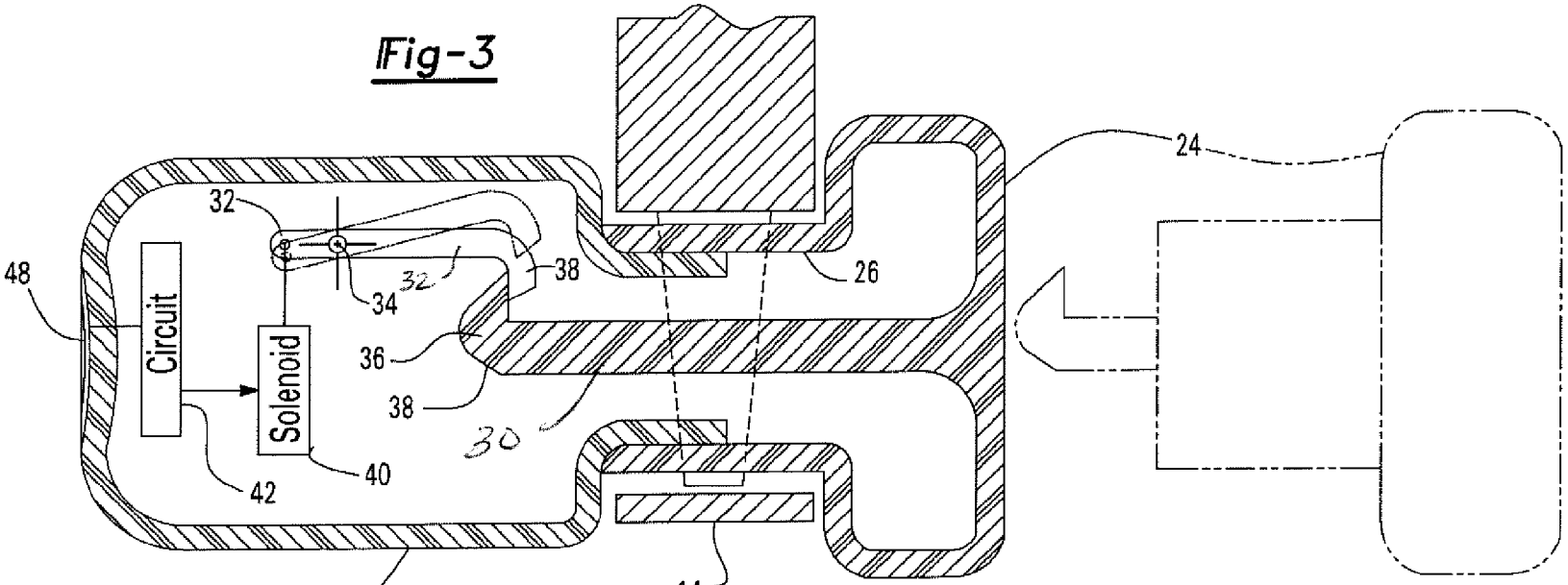
FIG. 3 illustrates a partial sectional and partial diagrammatic view of the preferred embodiment of the invention.

With reference now to FIGS. 1-3, a trigger guard 20 in accordance with the present invention includes a first housing part 22 and a second housing part 24. At least one of the housing parts, shown as housing part 24 in FIG. 3, includes a shackle 26 which is insertable through the trigger guard 14 of the gun 10 as shown in solid line in FIG. 3. With the shackle 26 positioned through the trigger guard 14 and against the other housing part 22, the housing parts 24 and 22 are positioned on opposite sides of the trigger guard 14 and shield the trigger 12 from actuation. In addition, the shackle 26 itself when positioned through the trigger guard 14 mechanically blocks actuation of the trigger 12.

With reference now to FIG. 3, the housing parts 22 and 24 are movable between a locked position, illustrated in solid line in FIG. 3, and an unlocked position, illustrated in phantom line in FIG. 3. In its locked position, the housing parts 22 and 24 are locked together with the shackle 26 through the trigger guard 14 and effectively prevent use or discharge of the gun 10. Conversely, with the housing parts 22 and 24 in their unlocked position, the housing parts 22 and 24 may be separated from each other, removed from the trigger guard 14, and normal operation of the gun 10 may ensue.

Still referring to FIG. 3, although any conventional means may be employed to selectively lock the housing parts 22 and 24 together, or to release them, in the preferred embodiment of the invention a stationary latch 30 is secured to one housing part 24. Conversely, a pivotal latch 32 is mounted in the other housing part 22 so that the latch 32 is pivotal about a pivot pin 34.

The stationary latch 30 includes a hook 36 at its free end and, similarly, the pivotal latch 32 includes a hook 38 at one end. The hooked ends 36 and 38 of the stationary latch 30 and pivotal latch 32 engage and lock together when the shackle 26 is inserted against, onto, or into the housing part 22. The pivotal latch 32, however, is movable between a locked position, shown in solid line in FIG. 3, and an unlocked position, shown in phantom line in FIG. 3. In its locked position, the latch 32 secures the two housing parts 22 and 24 together. Conversely, in its unlocked position shown in phantom line, the hooked ends 36 and 38 of the latches 30 and 32, respectively, disengage and permit the housing parts 22 and 24 to be separated from each other.

In order to move the pivotal latch 32 between its locked and unlocked positions, a solenoid 40 is contained in the housing part and mechanically coupled to the end of the pivotal latch 32 opposite from its hooked end 38. Thus, extension or retraction of the solenoid simultaneously pivots the pivotal latch 32 as desired.

Other types of latch mechanisms to selectively lock the housing parts together may be used without deviation from the scope or spirit of the invention.

Figure 4:
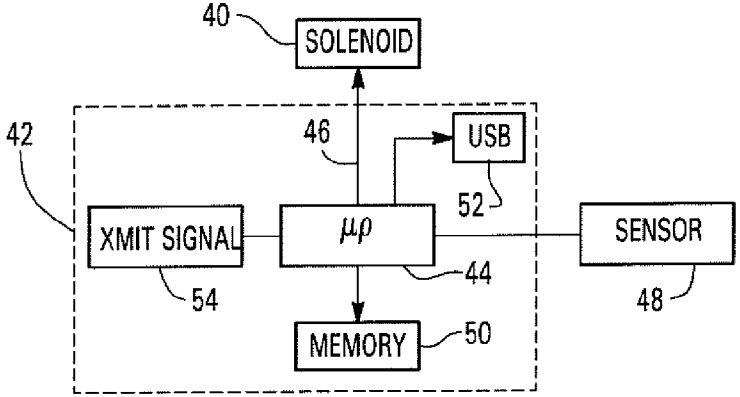
FIG. 4 is a block diagrammatic view illustrating the circuitry of the present invention.

As best shown in FIG. 4, a circuit 42 controls the operation of the solenoid 40. The circuit 42 is shown in greater detail in FIG. 4 and includes a processor 44 having an output control line 46 to control the actuation of the solenoid 40. A fingerprint sensor 48 (see also FIG. 1) is mounted on the housing part 22 and, when swiped by a fingerprint, generates an output signal representative of that fingerprint to the processor 44. Furthermore, as used in this patent, the term "fingerprint" shall expressly include thumbprints.

The processor 44 is programmed, after proper training, to recognize the fingerprint of an authorized user or authorized users. Upon receipt of the swipe of the fingerprint from an authorized user, the processor 44 generates an output signal on output line 46 to the solenoid 40 in order to move the pivotal latch 32 to its unlocked position. Preferably, the processor 44 will keep the pivotal latch 32 in its unlocked position for a period of time, e.g. several seconds, to permit the housing parts 22 and 24 to be removed from the gun 10 as desired.

As an added feature of the present invention, in the event that the sensor 48 is swiped by someone other than an authorized user, the processor 44 stores the information relating to the fingerprint in available memory 50. That fingerprint information may then be subsequently downloaded through an output port 52, such as a USB port, upon a subsequent command by an authorized user. For example, the processor 44 may store a plurality of fingerprint swipes by unauthorized users in the memory 50 for subsequent download through the port 52. Such a download would enable the unauthorized users to be identified.

In the event that the fingerprint sensor 48 is swiped by the fingerprint of an unauthorized user, the processor 44 optionally activates a transmitter 54 to generate a wireless signal. That wireless signal can include, for example, a Wi-Fi signal, telephone signal, Bluetooth signal, and/or the like. The Wi-Fi signal can then be used to contact the authorized user of the gun by sending a text message, email, or the like.

From the foregoing, it can be seen that the present invention provides a simple and yet effective trigger lock for a gun. A primary advantage of Applicant's invention is that it requires neither a key nor combination, both of which can be lost or forgotten. Furthermore, during an emergency situation, the trigger lock may still be easily activated by simply swiping one's fingerprint over the sensor.

Having described my invention, many modifications thereto will become apparent to those having skill in the art without deviation from the spirit of the invention as defined by the scope of the appended claims.

I claim:

1. A trigger lock for a gun having a trigger and a trigger guard comprising:

a first housing part and a second part, said housing parts being completely separable from each other, at least one of said parts having a shackle insertable through the trigger guard and against or into the other housing part so that said housing parts are on opposite sides of the trigger guard and so that said shackle prevents actuation of the trigger, a first latch mounted to said first housing parts and pivotal between a locked and an unlocked position, wherein in said locked position, said first latch engages a fixed latch in said second housing part and secures said housing parts together, and wherein in said unlocked position, said first latch releases said fixed latch so that said housing parts may be completely separated from each other, a fingerprint scanner mounted in said first housing part which generates an output signal when swiped by a fingerprint, a processor contained in said first housing part which receives the output signal from the scanner when swiped, said processor programmed to identify an authorized user(s) of the gun and, when the authorized user is identified, activate a mechanism to move said latch to said unlocked position.

2. The trigger lock as defined in claim 1 wherein said latch moving mechanism comprises a solenoid.

3. The trigger lock as defined in claim 1 and comprising a transmitter, said processor being connected to said transmitter and activating said transmitter to transmit a signal when said sensor is swiped by someone other than the authorized user(s).

4. The trigger lock as defined in claim 3 wherein said transmitter transmits a Wi-Fi signal.

5. The trigger lock as defined in claim 3 wherein said transmitter transmits a Bluetooth signal.

6. The trigger lock as defined in claim 3 wherein said transmitter transmits a text message.

7. The trigger lock as defined in claim 3 wherein said transmitter transmits an email.

8. The trigger lock as defined in claim 1 and comprising an output port connected to said processor, said processor programmed to store at least a plurality of prior swipes of said sensor and output to said output port a history of prior swipes of the sensor upon command by the authorized user(s).

* * * * *